US005996321A

United States Patent [19]

Focke et al.

[11] Patent Number: 5,996,321

[45] Date of Patent: Dec. 7, 1999

[54] METHOD AND DEVICE FOR MANUFACTURING HINGE-LID PACKETS FOR CIGARETTES

[75] Inventors: Heinz Focke, Verden; Harald Freudenberg, Marklohe, both of Germany

[73] Assignee: Focke & Co. (GmbH & Co.), Verden, Germany

[21] Appl. No.: 09/108,744

[22] Filed: Jul. 1, 1998

[30] Foreign Application Priority Data

Jul. 4, 1997 [DE] Germany ..... 197 28 515

[51] Int. Cl.[6] ..... B65B 35/30

[52] U.S. Cl. ..... 53/540; 53/252; 53/541; 414/788.1; 414/796.2

[58] Field of Search ..... 414/788.1, 788.9, 414/788, 793.8, 794.5, 794.6, 796.2; 53/447, 540, 541, 389.1, 252, 534, 542, 544

[56] References Cited

U.S. PATENT DOCUMENTS

| | | | |
|---|---|---|---|
| 4,333,298 | 6/1982 | Lehmacher | 535/540 |
| 5,499,489 | 3/1996 | Perobelli et al. | 53/540 |
| 5,727,365 | 3/1998 | Lashyro et al. | 53/252 |
| 5,794,416 | 8/1998 | Rahman | 53/540 |
| 5,842,327 | 12/1998 | Schwede | 53/540 |

FOREIGN PATENT DOCUMENTS

| | | | |
|---|---|---|---|
| 258 597 | 3/1988 | European Pat. Off. . | |
| 421 148 | 4/1991 | European Pat. Off. . | |
| 36 27 868 | 2/1988 | Germany . | |
| 38 11 993 | 11/1988 | Germany . | |
| 40 24 450 | 2/1991 | Germany . | |
| 40 00 263 | 7/1991 | Germany . | |
| 91 09 971 | 1/1992 | Germany . | |
| 43 01 169 | 7/1994 | Germany . | |
| 692 00 042 | 7/1994 | Germany . | |
| 4 36 330 | 4/1996 | Germany . | |
| 1428768 | 3/1976 | United Kingdom | 53/541 |
| 2 257 960 | 1/1993 | United Kingdom . | |

*Primary Examiner*—Eugene L. Kim
*Attorney, Agent, or Firm*—Sughrue, Mion, Zinn, Macpeak & Seas, PLLC

[57] ABSTRACT

Method and device for manufacturing hinge-lid packets for cigarettes from individual, prefabricated blanks (11) which are delivered as piles (10) of blanks. Before being transferred to a packaging machine, each pile (10) of blanks is laterally aligned in respect of the exact relative position of the blanks (11), by aligning devices (21, 25, 27, 28) acting on all the upright side faces of the pile (10) of blanks. A separate aligning member, namely a slide (37) serves to align a lower, incorrectly positioned blank (11). This slide is effective in the region of a residual pile of the pile (10) of blanks, namely by raising a predominant upper partial pile.

10 Claims, 6 Drawing Sheets

Fig. 6
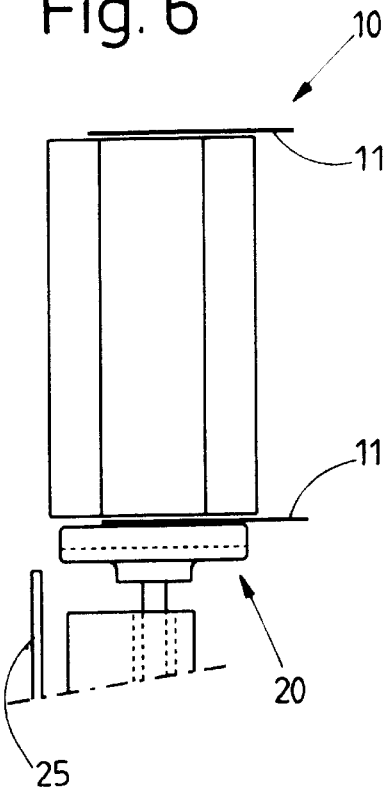
Fig. 7
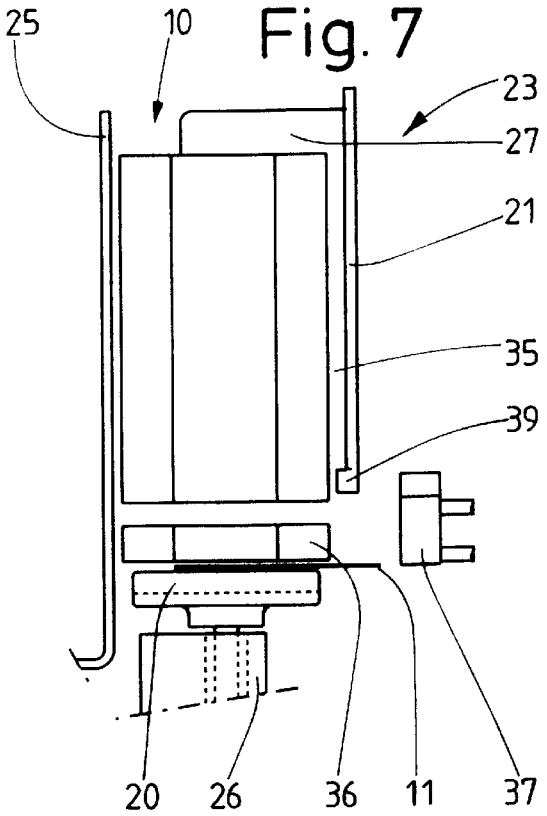
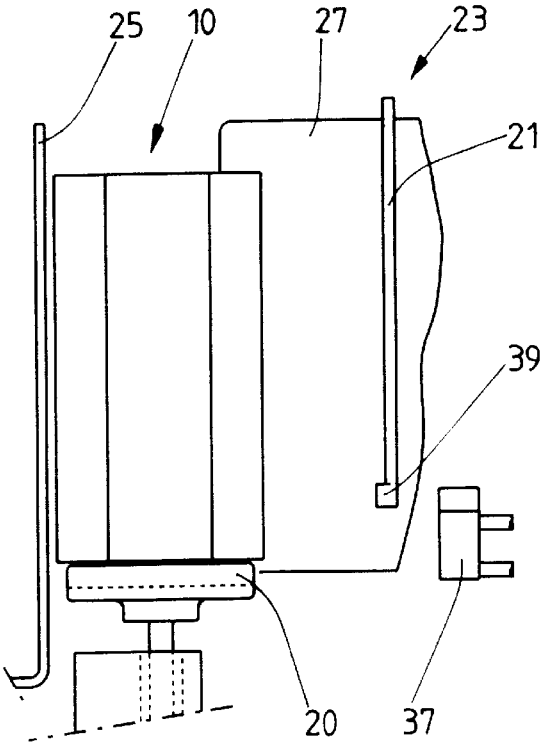
Fig. 8
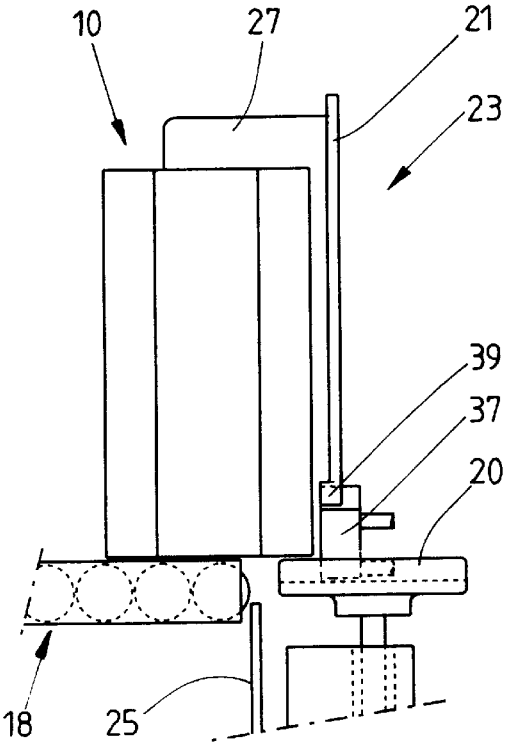
Fig. 9

METHOD AND DEVICE FOR MANUFACTURING HINGE-LID PACKETS FOR CIGARETTES

BACKGROUND OF THE INVENTION

The invention relates to a method and a device for manufacturing packets from pre-fabricated blanks made of thin cardboard or the like, especially for manufacturing cigarette packets of the hinge-lid type, the pre-fabricated blanks being delivered as piles of blanks and being led by a conveyor for piles of blanks to a packaging machine.

Hinge-lid packets are a widespread type of packaging for cigarettes. Hinge-lid packets consist characteristically of contoured blanks made of (thin) cardboard. Piles of blanks are generally delivered on pallets and are positioned in order to transfer the pile of blanks to the packaging machine. On the pallets, the piles of blanks are disposed in rows beside one another and in layers above one another.

Between the layers there is an intermediate blank, on which the blanks of the respective upper layer rest.

Lifting appliances of different kinds are known for raising the piles of blanks, individually or in groups, from the pallet or the respective intermediate blank and transfering them to the conveyor for the piles of blanks. Advantageous designs of lifting appliance are those on which individual piles of blanks are grasped on upright side faces, raised from the pallet or the intermediate blank and lowered on to the conveyor for the piles of blanks.

When the pallet is loaded (at the factory) with piles of blanks, during the transport of said blanks and during the removal of the piles of blanks from the pallet, it is not possible to avoid individual or a plurality of blanks from one pile being displaced sideways and thus portions of the blanks projecting over the contours of the pile of blanks. This is particularly true for the lower and upper regions of the pile of blanks, i.e. for lower and upper blanks of same.

SUMMARY OF THE INVENTION

Proceeding from this, the object underlying the invention is better to prepare piles of blanks for processing in the region of the packaging machine.

In fulfilment of this object, the method according to the invention is characterised in that each pile of blanks is aligned in respect of the exact relative position of all the blanks before they are transferred to the packaging machine.

Underlying the invention is the recognition that incorrectly aligned piles of blanks, especially those with displaced blanks at the top and at the bottom cause faulty, inefficient operation of the packaging machines.

On the device according to the invention, individual piles of blanks are aligned during a momentarily standstill phase and then led by a conveyor for these piles of blanks to the packaging machine. Advantageously, four aligning members are provided which come into contact with the pile of blanks on opposite sides, namely on the longitudinal sides on the one hand and on the transverse sides on the other hand and thus align the blanks towards one another. One of the aligning members here serves at the same time as a slide to push the aligned pile on to the conveyor for the piles of blanks.

Particularly important are measures according to the invention for aligning the lower blanks of a pile of blanks, which in some cases clearly project at the side over the contour of the pile of blanks. In order to align these blanks, a lower partial region of the blank is relieved of pressure, namely by relative raising of the upper part of the pile of blanks. A lower residual pile of blanks makes it easier to push in remaining blanks in this region of the pile.

Further details and advantages of the invention are explained in greater detail below with the aid of the drawings. These show:

BRIEF DESCRIPTION OF THE DESCRIPTIONS

FIG. 1 a device for handling piles of blanks, in perspective view,

FIG. 2 the device according to FIG. 1, in side view,

FIG. 3 the device according to FIG. 1 and FIG. 2, in plan view,

FIG. 4 a detail of the view according to FIG. 3, namely an aligning station, on an enlarged scale, FIG. 5 the detail of FIG. 4 in side view, without the pile of blanks, FIGS. 6–9 successive phases of the alignment of a pile of blanks, in side view.

DESCRIPTION OF A PREFERRED EMBODIMENT

Figure 3:
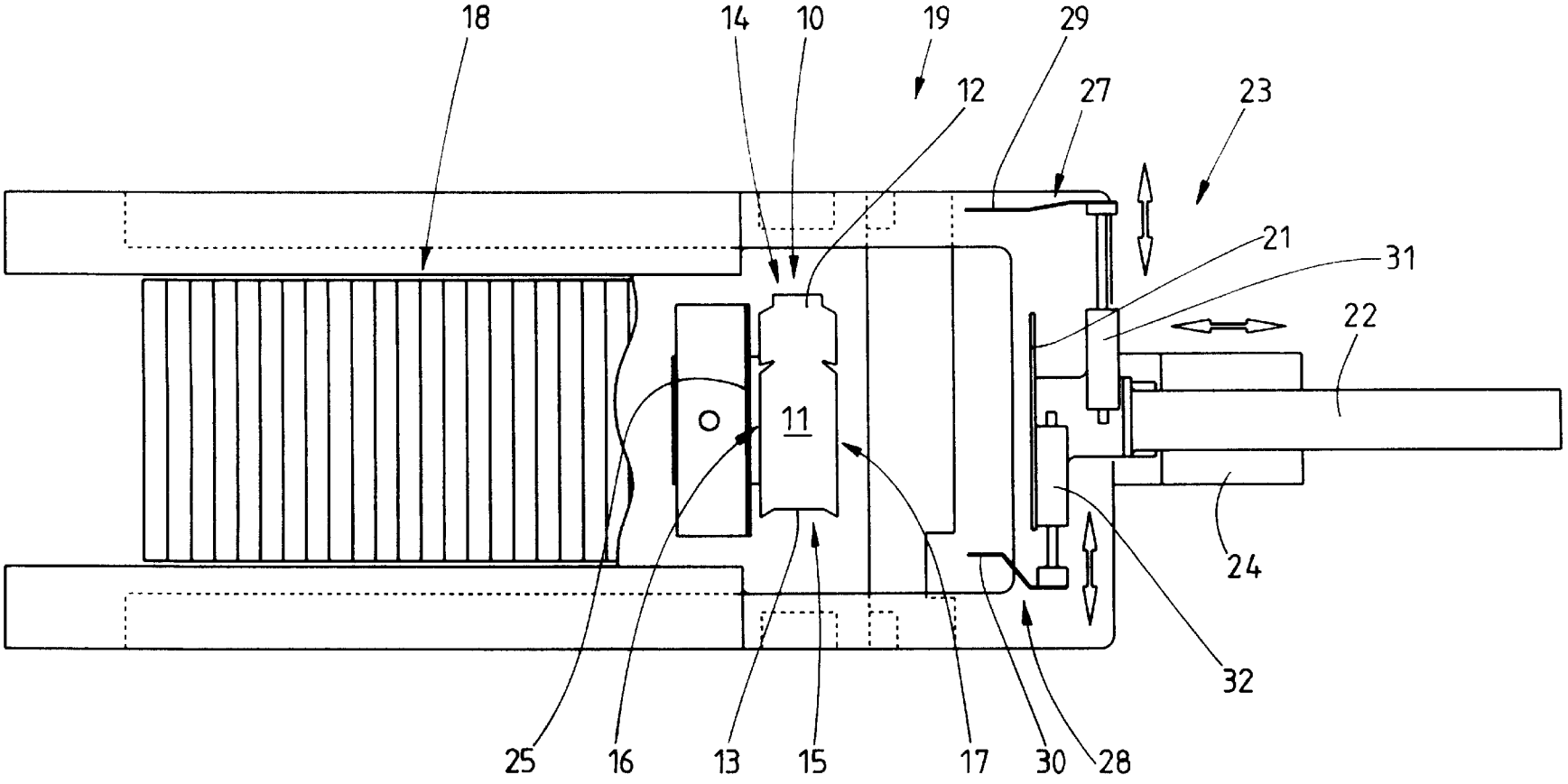

The embodiment, given by way of example and shown in the drawings, is concerned with the handling of piles 10 consisting of blanks 11 for the manufacture of (cigarette) packets of the hinge-lid type. The blanks 11 consist of thin cardboard. The particular design of the packet, namely the hinge-lid packet, gives rise to a characteristic contour of the blanks 11 and thus to the pile 10 of blanks formed from same. The blanks 11 are stretched out, approximately rectangular formations with a rectangular projection 12 (FIG. 3) on the one side and a trapezoid depression 13 on the opposite side. The projection 12 arises as a result of a lid inner flap of the hinge-lid packet. Depression 13 arises through an upper closing edge of a front wall of the hinge-lid packet and adjoining sloping edges in the region of side flaps. This design of the blanks 11 produces narrower, upright transverse sides 14, 15 of the pile 10 of blanks. Longer side faces 16 and 17 are largely flat-surfaced and parallel to one another.

The piles 10 of blanks are made available for the manufacture of packets in a largish number, especially on pallets. On the pallets, the piles 10 of blanks are positioned in a plurality of parallel rows beside one another and in a plurality of layers above one another. Between the layers there is generally situated an intermediate blank made of paper, foil or the like.

The piles 10 of blanks can be removed individually or in groups from the pallet. On the present embodiment, the piles 10 of blanks are de-palletized individually.

The piles 10 of blanks are transferred to a conveyor 18 for piles of blanks, which carries the pile 10 of blanks to the packaging machine (not shown) or to a blanks magazine. The conveyor 18 for piles of blanks is here configured as an accumulating roller conveyor.

The piles 10 of blanks are handled before transfer to the packaging machine to ensure correct, aligned, relative position of the individual blanks 11. To this end, the piles 10 of blanks are transferred individually to an aligning station 19 placed in front of the conveyor 18 for the piles of blanks. The pile 10 of blanks rests here for a moment on a base, namely on a platform 20. This is configured essentially rectangular with its longitudinal extension transverse to the conveying direction of the conveyor 18 for the piles of blanks. The stretched out piles of blanks 18 are positioned correspondingly on the platform 20. The bearing surface of the platform 20 is slightly smaller than the outer dimensions of the pile 10 of blanks, such that the pile protrudes on all sides over the platform 20.

Aligning members in the region of the aligning station 19 serve to align the pile 10 of blanks or to displace any blanks 11 which are lying in the wrong position. These aligning members are plate-shaped formations which may be moved in an upright position laterally against the sides of the pile 10 of blanks and thus align same in respect of the relative position of the blanks 11.

In the present embodiment, one aligning member is associated with each upright face 14, 15, 16, 17 of the pile 10 of blanks. On the side face 17 turned away from the conveyor 18 for the piles of blanks is arranged a longitudinal aligning device 21 which may be moved transversely to this side face 17. This is an upright plate-shaped formation, which may be driven horizontally, in the present case by an actuating cylinder 22 which has no piston rod. The arrangement is such that the actuating cylinder 22 may be moved with an aligning device 23 in a horizontal plane backwards and forwards. The actuating cylinder 22 here runs in a stationary guide 24. A catch (not shown) moving laterally out of the actuating cylinder 22 is connected with the guide 24, such that when there is an impact on the piston in the actuating cylinder 22, said cylinder is moved in the one or other direction together with the aligning unit 23.

The longitudinal aligning device 21 is driven as part of the aligning unit 23 against the facing side surface 17 of the pile 10 of blanks. On the opposite side, namely with the side surface 16, the pile 10 of blanks places itself against a counter-member, against an upright plate-shaped counter-aligning device 25.

The counter-aligning device 25 is arranged directly in the initial region of the conveyor 18 for the piles of blanks, namely before its end. The counter-aligning device 25 may be moved up and down in a gap formed between the conveyor 18 for the piles of blanks and the platform 20, by a lifting member 26. The counter-aligning device 25 is only moved for the working cycle of the alignment into the upper aligning position shown in FIG. 2; thereafter, namely in order to push the pile 10 of blanks on to the conveyor 18 for the piles of blanks, it is lowered into a position below the plane of movement of the pile 10 of blanks.

The process of aligning the pile 10 of blanks also extends to the transverse faces 14, 15. To this end, transverse aligning devices 27, 28 are provided which may be moved by corresponding relative movement to the transverse faces 14, 15 and in a partial region have a form fit with these faces. The transverse aligning device 27 associated with the transverse face 14 is a plate which has a cross-section bent at right angles. One free end arm 29 lies on the face formed by the projection 12 of the pile 10 of blanks. The opposite transverse aligning device 28 is likewise configured as a plate bent at right-angles, offset to a greater extent. One end arm 30 enters the depression 13 of the pile of blanks and adjoins a partial face formed by closing edges of front walls of the blank 11.

Figure 4:
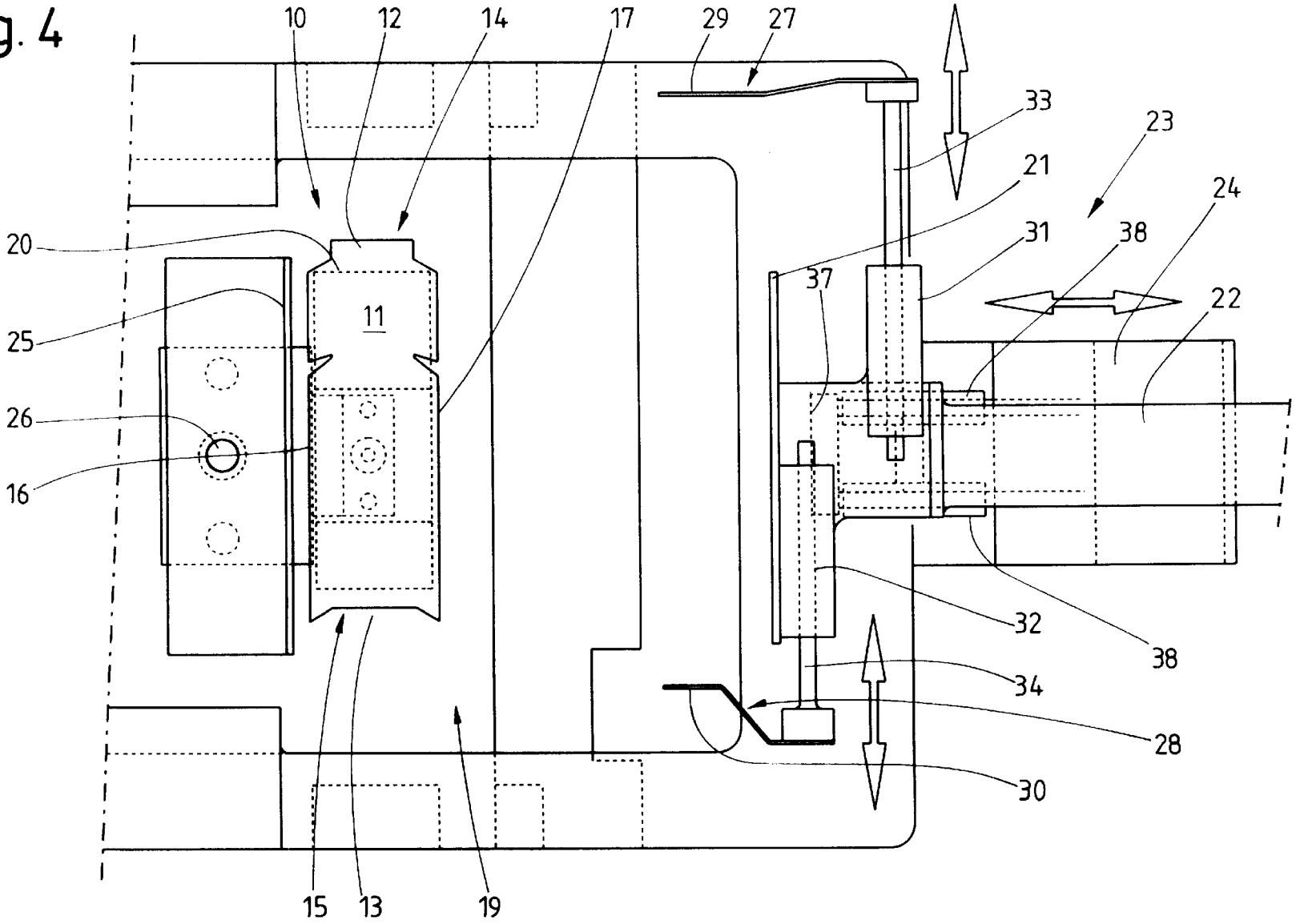
Figure 5:
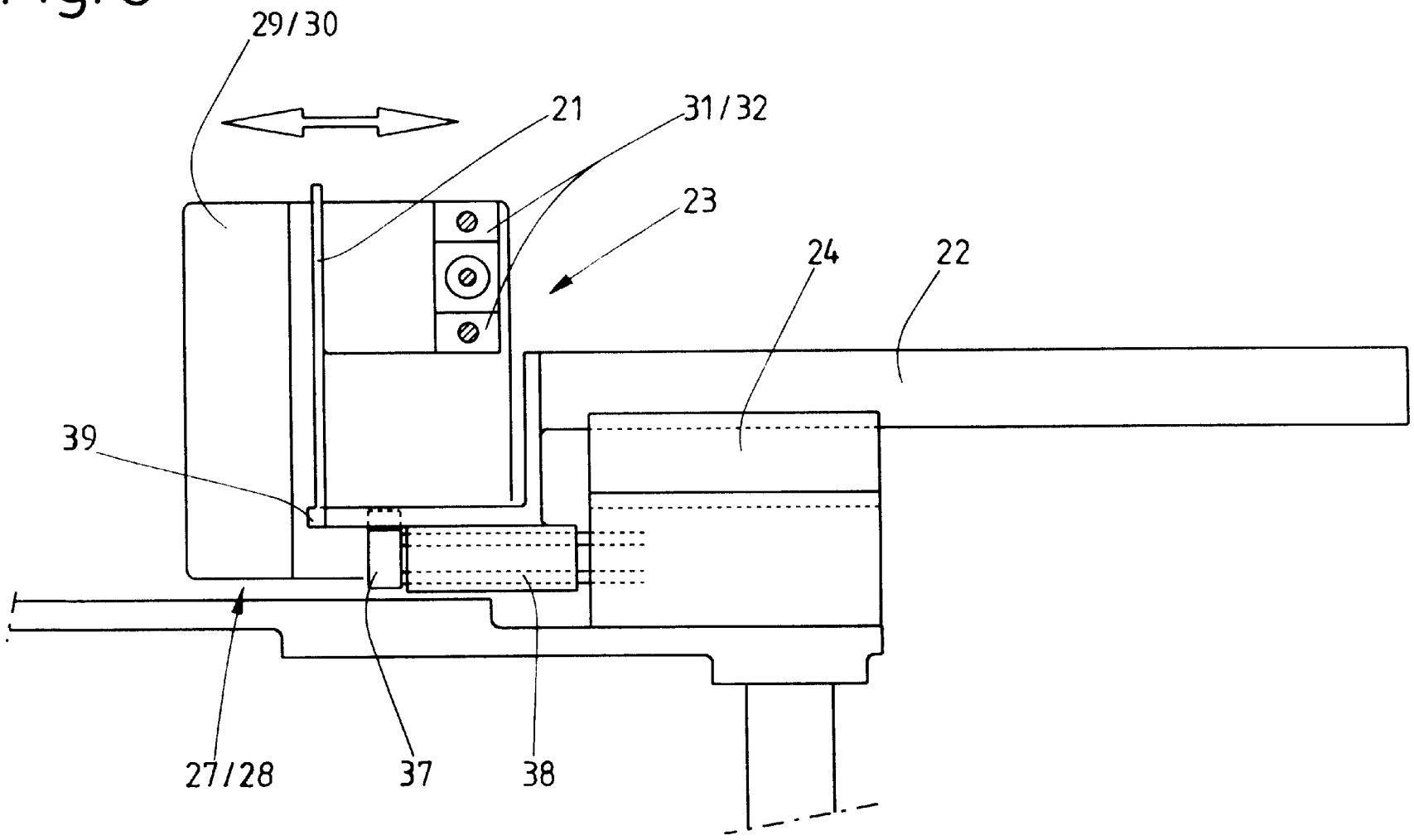

The transverse aligning devices 27, 28 are attached to the aligning unit 23 and may be moved with the latter corresponding to the movement direction of the longitudinal aligning device 21 out of a drawn-back position as per FIG. 4 into an aligning position as per FIG. 7 and FIG. 9. In the latter, the transverse aligning devices 27, 28 are first of all located at a spacing from the facing transverse faces 14, 15. Through a movement against the pile 10 of blanks, i.e. in a direction towards one another, the transverse aligning devices 27, 28 are moved until they come into contact with the end arms 29, 30 of the respective transverse faces 14, 15. Through their position resting (with very little pressure) on the pile 10 of blanks, the blanks 11 of the latter are aligned exactly by the upright faces of the transverse aligning devices 27, 28.

The transverse aligning devices 27, 28 are mounted on the aligning unit 23 so as to be displaceable (in a transverse direction). Associated with each transverse aligning device 27, 28 is a guide 31, 32 on the aligning unit 23. In this guide, guide rods 33, 34 connected with each transverse aligning device 27, 28 may be moved. Actuating members for the guide rods 33, 34 are not shown for reasons of clarity. The movements of the members of the aligning unit 23 are represented in FIG. 4 by double arrows.

When the piles 10 of blanks are transferred to the packaging machine, respectively one pile 10 of blanks is lowered on the platform 20, thereafter affected on all four sides by aligning members and transferred to the conveyor 18 for the piles of blanks. To this end, the counter-aligning device 25 is lowered first of all. The aligning unit 23 or its longitudinal aligning device 21, acts as a slide for the pile 10 of blanks. The movement of the aligning unit 23 or of the longitudinal aligning device 21 in the direction towards the pile 10 of blanks is continued, whereby the pile 10 of blanks is pushed off the platform 20 and transferred to the conveyor 18 for the piles of blanks.

An important special characteristic arises especially from the course of the alignment of a pile 10 of blanks as shown in FIGS. 6–7. Here it is a question above all of handling blanks 11 positioned incorrectly in the lower region of the pile 10 of blanks or at its lower side. In FIG. 6 and FIG. 7, a blank 11 is shown on the lower side of the pile 10 of blanks which clearly projects laterally beyond the contour of the pile 10 of blanks. Pushing the blank 11 into the correct position is problematic because of the dead weight of the pile 10 of blanks resting on it. For this reason, there is a reduction in the weight so that the lower blank 11 can be pushed into position.

On the solution shown in the drawings, an upper larger partial pile of blanks 35 is raised in the region of the platform 20 so that the small residual pile 36 remains on the platform 20. The weight of the latter is so small that the blank 11 projecting below can be moved into the correct position for the pile by a slide 37 which may be moved in the corresponding direction. The slide 37 is also disposed in the present case on the aligning device 23 and may be moved in guides in the lower region of same. The slide 37 may be moved on its own, for example by a cylinder (not shown).

According to FIG. 6–FIG. 9, the procedure is such that, after a pile 10 of blanks has been set down on the platform 20, first of all the counter-aligning device 25 is driven by an upward movement into the aligning position (FIG. 7). Thereafter, the aligning unit 23 is advanced, in such a way that the longitudinal aligning device 21 comes to lie on the facing side face 17 of the pile 10 of blanks. On this embodiment, the longitudinal aligning device 21 extends only over an upper partial height of the pile 10 of blanks, namely corresponding to the upper partial pile 35. The latter is gripped by the contact pressure of the longitudinal aligning device 21 on the side face 17 and held by means of a clamping effect.

The lower residual pile 36, not grasped by the longitudinal aligning device 21, is separated from the upper partial pile 35, through a corresponding downward movement of the platform 20 with the residual pile 36 (position as per FIG. 7). The lower blank 11, projecting sideways, is now largely freed of load. The slide 37 is actuated, namely in a direction towards the pile 10 of blanks or residual pile 36. Here the protruding blank 11 is pushed into the pile 10 of blanks. The slide is then pulled back. The residual pile 36 is added to the partial pile 35 again by raising the platform 20. The complete aligning unit 23 is drawn back (FIG. 8). Through a movement in the opposite direction, the aligned pile 10 of blanks is then pushed from the platform 20 and on to the conveyor 18 for the piles of blanks.

The transverse aligning devices 27, 28 can also have a contributory effect in these measures in different ways. By preference, the transverse aligning devices 27, 28 are pulled back out of the aligning position, i.e. out of their position in contact with the pile 10 of blanks, into the position as per FIG. 4 before the measures arising from FIG. 7 and FIG. 8 are carried out. However it is also possible so to configure the aligning devices 27, 28 that they serve in analogous fashion to the longitudinal aligning device 21 as clamping or holding members for the upper partial pile 35. During the movement of pushing the pile 10 of blanks on to the conveyor 18 for the pile of blanks, the transverse aligning members 27, 28 are drawn back into the position as per FIG. 4. Here the lower slide 37 acts as an extension of the longitudinal aligning member 21, and is accordingly moved together with same as one unit.

In order to fix the upper partial pile 35 temporarily, the longitudinal aligning member 21 is provided on its lower edge with a pressure member, namely a pressure strip 39. This consists of a resilient material, especially of cellular rubber. The pressure strip 39 creates locally, namely on the lower region of the partial pile 35, an increased contact pressure such that the partial pile 35 is held securely. The partial blank 35 can alternatively be divided by relative transverse movement from the residual pile 36 and thus the latter is freed of load.

Figure 1:
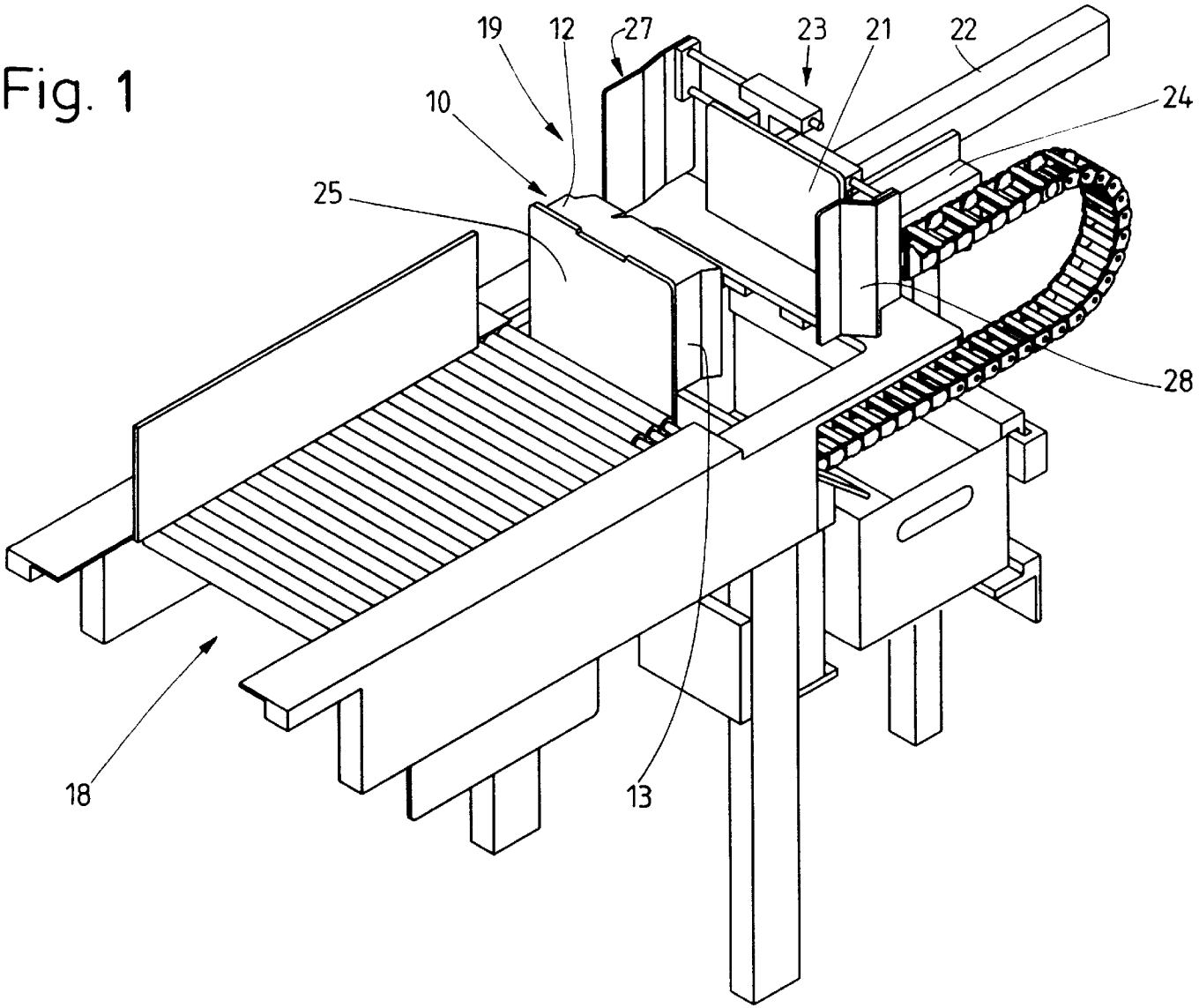
Figure 2:
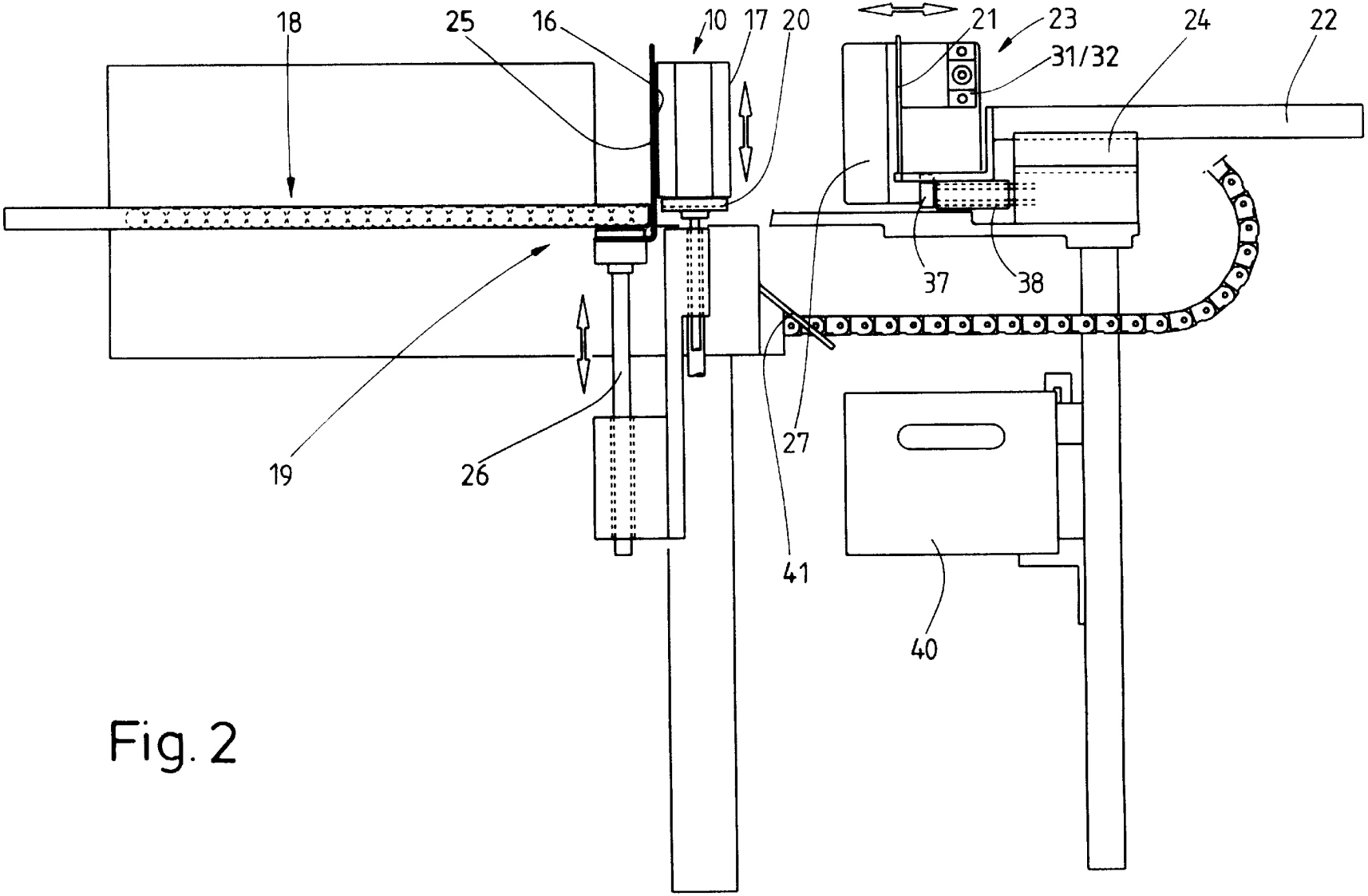

A further special characteristic is shown in FIG. 1 and FIG. 2.

If, on the basis of an extremely divergent relative position to the pile 10 of blanks individual blanks 11 in the region of the aligning station 19 cannot be held and fall down below as a result of their own weight, such blanks are caught by a collecting container 40. The collecting container 40 is positioned slightly offset to the aligning station 19. A guide plate, directed sloping downwards, leads falling blanks 11 into the collecting container 40.

What is claim is:

1. An apparatus for manufacturing cigarette packs from prefabricated (11) made of thin cardboard, the blanks (11) being delivered as piles (10) of blanks and fed to a cigarette packing machine, said apparatus comprising:

an aligning station (19) in which the blanks (11) of each pile (10) are aligned;

means for feeding the pile (10), before being transferred to the packaging machine, to said aligning station (19) in order to align the blanks (11) of the pile (10);

in the aligning station (19), a platform (20) on which the pile (10) of blanks rests;

disposed next to the platform (20), a counter-aligning member (25), which is vertically movable up and down, for engaging a large-surface first side face (16) of the pile in an aligning position of the counter-aligning member (25);

a longitudinal aligning member (21) movable in a horizontal plane;

first moving means for moving said longitudinal aligning member (21) in an aligning movement against an opposite large-surface side face (17) of the pile (10) so that the pile (10) rests against both the longitudinal aligning member (21) and also the counter-aligning member (25);

second moving means for, after the pile (10) of blanks has been aligned, moving the counter-aligning member (25) out of said aligning position so that said first side face (16) of the pile (10) of blanks is exposed; and a pile conveyor (18) for conveying aligned piles in a conveying direction away from said aligning station, said first moving means also moving said longitudinal aligning member (21) to push the pile (10) of blanks off the platform (20) and onto said pile conveyor (18) which conveys the aligned pile (10) of blanks to the packaging machine.

2. The apparatus according to claim 1, further comprising:

two transverse aligning devices (27, 28); and means for moving said two transverse aligning devices (27, 28) back and forth in the horizontal plane, in the direction of mutually opposite transverse faces (14, 15) of the pile (10), so that said transverse aligning devices (27, 28) respectively lie against the opposite transverse faces (14, 15).

3. The apparatus according to claim 1, further comprising respective end arms (29, 30) on said transverse aligning devices (27, 28), said transverse aligning devices (27, 28) having a shape adapted to the contour of said transverse faces (14, 15) of the pile (10) such that, during the alignment of the pile, said end arms (29, 30) respectively abut on regions of said transverse faces (14, 15) of the pile (10), said regions being formed by projections (12) and depressions (13) which are formed in each pile (10) by corresponding projections and depressions in the blanks of the pile.

4. The apparatus according to claim 3, wherein said transverse aligning devices (27, 28) are plate-like structures, wherein at least one of said transverse aligning devices (27, 28) has a form with an angled cross-section, and wherein the respective end arm (30) of said one transverse aligning device enters the depression (13) formed in the respective transverse face (15) of the pile.

5. The apparatus according to claim 2, further comprising:

a movable aligning unit (23) on which are disposed said longitudinal aligning member (21) and said transverse aligning devices (27, 28); and means for moving the aligning unit (23) in a movement direction which is toward the pile (10), and which corresponds to the aligning movement of the longitudinal aligning member (21), wherein said transverse aligning members (27, 28) are displaceably mounted on said aligning unit (23) and are movable back and forth transverse to the movement direction of said aligning unit (23).

6. The apparatus according to claim 5, wherein the pile (10) has an upper pile portion (35) and a lower pile portion (36), said apparatus further comprising an independently movable aligning slide (37) disposed on said aligning unit (23) for aligning said lower pile portion (36).

7. The apparatus according to claim 6, wherein said upper pile portion (35) contains more blanks (11) than said lower pile portion (36), said apparatus further comprising:

to align at least one lower blank (11) of the pile (10), separating means for separating the lower pile portion (36) from the upper pile portion (35) by lowering the lower pile portion (36) so that the lower pile portion (36) can be aligned in its separated position by the slide (37), said separating means then raising the lower pile portion (36) from said separated position to rejoin it to the upper pile portion (35).

8. The apparatus according to claim 7, wherein said longitudinal aligning device (21) has a height corresponding to that of said upper pile portion (35), wherein the upper pile portion (35) is fixed by said longitudinal aligning member (21) by clamping the upper pile portion (35) in conjunction with said counter-aligning member (25) opposite said longitudinal aligning member (21), and wherein the lower pile portion (36) is separated from the upper pile portion (35) by lowering said platform (20).

9. The apparatus according to claim 8, wherein the longitudinal aligning member (21) is configured, at least on a region of a lower edge thereof, as a clamping member in the form of a pressure strip (39) made of resilient material and lying against the pile (10) of blanks.

10. The apparatus according to claim 2, further comprising a collecting container (40) for blanks (11) which fall out of the aligning station (19) by their own weight.

* * * * *